US012369680B2

(12) United States Patent
Iuchi et al.

(10) Patent No.: US 12,369,680 B2
(45) Date of Patent: Jul. 29, 2025

(54) SHOE SOLE

(71) Applicant: Shimano Inc., Osaka (JP)

(72) Inventors: Kadunori Iuchi, Osaka (JP); Junichi Kikuta, Osaka (JP); Toshiaki Aoki, Osaka (JP)

(73) Assignee: Shimano Inc., Osaka (JP)

( * ) Notice: Subject to any disclaimer, the term of this patent is extended or adjusted under 35 U.S.C. 154(b) by 58 days.

(21) Appl. No.: 17/747,414

(22) Filed: May 18, 2022

(65) Prior Publication Data

US 2023/0371644 A1 Nov. 23, 2023

(51) Int. Cl.

| | |
|---|---|
| ***A43B 13/12*** | (2006.01) |
| ***A43B 13/02*** | (2022.01) |
| ***A43B 13/04*** | (2006.01) |
| ***A43B 13/14*** | (2006.01) |
| ***A43B 17/00*** | (2006.01) |

(52) U.S. Cl.

CPC ..... *A43B 13/12* (2013.01); *A43B 13/026* (2013.01); *A43B 13/04* (2013.01); *A43B 13/141* (2013.01); *A43B 13/146* (2013.01); *A43B 17/00* (2013.01)

(58) Field of Classification Search

CPC ..... A43B 13/12; A43B 13/026; A43B 13/04; A43B 13/141; A43B 13/146; A43B 13/386; A43B 17/006; A43B 7/22; A43B 7/1415; A43B 7/142; A43B 17/08

USPC ..... 36/145, 43

See application file for complete search history.

(56) References Cited

U.S. PATENT DOCUMENTS

| | | | | |
|---|---|---|---|---|
| 1,470,618 | A * | 10/1923 | Craine | A43B 7/142 36/179 |
| 2,129,424 | A * | 9/1938 | Jay | A43B 7/22 36/76 R |
| 3,999,558 | A * | 12/1976 | Barnwell | A43B 7/22 36/145 |
| 8,042,287 | B2 * | 10/2011 | Reinhardt | A43B 7/144 36/179 |
| 9,936,765 | B2 | 4/2018 | Sato et al. | |
| 11,272,756 | B2 | 3/2022 | Torrance | |
| 2006/0168846 | A1 * | 8/2006 | Juan | A43B 17/08 36/43 |
| 2006/0254093 | A1 * | 11/2006 | Fuchslocher | A43B 7/22 36/103 |
| 2009/0313856 | A1 * | 12/2009 | Arizumi | A43B 3/0057 36/102 |
| 2016/0051012 | A1 * | 2/2016 | Avar | A43B 13/127 36/103 |
| 2018/0132565 | A1 | 5/2018 | Granger et al. | |
| 2018/0338574 | A1 * | 11/2018 | Cross | A43B 13/189 |

(Continued)

FOREIGN PATENT DOCUMENTS

DE 10 2020 202 237 B4 5/2023

*Primary Examiner* — Alissa L Hoey
*Assistant Examiner* — Akwokwo Olabisi Redhead
(74) *Attorney, Agent, or Firm* — Global IP Counselors, LLP

(57) ABSTRACT

A shoe sole includes a first sole layer including a first region having a first rigidity, and a plurality of second regions having a second rigidity that is more flexible than the first rigidity. The plurality of the second regions extends in a longitudinal direction of the shoe sole. The plurality of the second regions is spaced from a toe edge of the first sole layer, and is spaced from a heel edge of the first sole layer. The plurality of the second regions has arcuate shapes bending in a same lateral direction.

18 Claims, 11 Drawing Sheets

(56) References Cited

U.S. PATENT DOCUMENTS

| | | | | |
|---|---|---|---|---|
| 2019/0365030 | A1* | 12/2019 | Chambers | A43B 13/14 |
| 2019/0373982 | A1* | 12/2019 | Dupre | A43B 13/127 |
| 2020/0170338 | A1* | 6/2020 | Lucca | A43B 13/12 |
| 2021/0259357 | A1 | 8/2021 | Paterson et al. | |
| 2021/0267304 | A1 | 9/2021 | Farris et al. | |

* cited by examiner

SHOE SOLE

BACKGROUND

Technical Field

This disclosure generally relates to a shoe sole for a shoe provided with the shoe sole.

Background Information

Generally, most shoes have an upper and a sole. The upper is stitched or adhesively bonded to the sole to form an interior foot receiving space for securely receiving a foot. The upper is typically formed from one or more flexible materials such as a textile fabric, a leather, and/or a synthetic leather that are stitched or adhesively bonded together. The upper can also include rigid reinforcements as needed and/or desired. The upper defines an ankle opening for inserting the wearer's foot into the interior foot receiving space and for removing wearer's foot from the interior foot receiving space. In addition, the upper can include a lace or other closure to more securely retain the shoe to the wearer's foot within the interior foot receiving space. The sole can be a single layer made of a suitable material, or can be made of several layers of different materials. In the case of many athletic shoes, the sole generally has an insole, a midsole and an outsole. The insole can define the bottom surface of the interior foot receiving space. The insole may be a thin compressible member that enhances the comfort of the shoe. The midsole is typically attached to the lower edge of the upper. The midsole is often a middle layer of the sole. The outsole is typically secured to a lower surface of the midsole, and forms a ground-contacting portion of the shoe.

SUMMARY

Generally, the present disclosure is directed to various features of a shoe sole that can increase the contact area between the shoe sole and a surface when the shoe sole contacts the surface at an oblique angle.

In view of the state of the known technology and in accordance with a first aspect of the present disclosure, a shoe sole is provided that basically comprises a first sole layer including a first region having a first rigidity, and a plurality of second regions having a second rigidity that is more flexible than the first rigidity. The plurality of the second regions extends in a longitudinal direction of the shoe sole. The plurality of the second regions is spaced from a toe edge of the first sole layer, and is spaced from a heel edge of the first sole layer. The plurality of the second regions has arcuate shapes bending in a same lateral direction.

With the shoe sole according to the first aspect, it is possible to reduce rigidity in a width direction of the shoe sole while maintaining rigidity in a longitudinal direction of the shoe sole.

In accordance with a second aspect of the present disclosure, the shoe sole according to the first aspect is configured so that the plurality of the second regions includes a plurality of elongated through openings.

With the shoe sole according to the second aspect, the stiffness in the width direction of the shoe sole can be easily reduced using a plurality of elongated through openings.

In accordance with a third aspect of the present disclosure, the shoe sole according to the first aspect or the second aspect is configured so that the plurality of the second regions extends to a stepping part of the shoe sole in the longitudinal direction.

With the shoe sole according to the third aspect, the stiffness in the width direction of the shoe sole can be easily reduced in the stepping part of the shoe sole.

In accordance with a fourth aspect of the present disclosure, the shoe sole according to any one of the first aspect to the third aspect further comprises a second sole layer at least partly overlapping the first sole layer. The second sole layer has a third rigidity that is more flexible than the first rigidity. The first sole layer is disposed closer to a top of the shoe sole than the second sole layer in a state where the shoe sole is assembled.

With the shoe sole according to the fourth aspect, the second sole layer can overlap the bottom surface of the first sole layer without restricting the stiffness in the width direction of the shoe sole.

In accordance with a fifth aspect of the present disclosure, the shoe sole according to any one of the first aspect to the fourth aspect is configured so that the first sole layer is disposed adjacent to an upper of a shoe in a state where the shoe sole is coupled to the upper.

With the shoe sole according to the fifth aspect, the first sole layer can reliably deform when obliquely stepping on a surface while maintaining rigidity in a longitudinal direction of the shoe sole.

In accordance with a sixth aspect of the present disclosure, the shoe sole according to any one of the second aspect to the fifth aspect is configured so that the plurality of the elongated through openings includes a first elongated through opening and a second elongated through opening. The first elongated through opening is located on an inner instep side of the second elongated through opening. The second elongated through opening is longer than the first elongated through opening.

With the shoe sole according to the sixth aspect, the operability of the outer instep side of the first sole layer is enhanced.

In accordance with a seventh aspect of the present disclosure, the shoe sole according to the sixth aspect is configured so that the plurality of the elongated through openings further includes a third elongated through opening located on an outer instep side of the second elongated through opening. The third elongated through opening is longer than the first elongated through opening.

With the shoe sole according to the seventh aspect, the operability of the outer instep side of the first sole layer is further enhanced.

In accordance with an eighth aspect of the present disclosure, the shoe sole according to the seventh aspect is configured so that the third elongated through opening is equal to or longer than the second elongated through opening.

With the shoe sole according to the eighth aspect, the operability of the outer instep side of the first sole layer can be easily regulated based on the length of the third elongated through opening.

In accordance with a ninth aspect of the present disclosure, the shoe sole according to any one of the sixth aspect to the eighth aspect is configured so that the plurality of the elongated through openings has a concavity towards the inner instep side.

With the shoe sole according to the ninth aspect, it is possible to provide smooth deformation of the first sole layer starts in the width direction of the shoe sole.

In accordance with a tenth aspect of the present disclosure, the shoe sole according to any one of the second aspect to the ninth aspect is configured so that the first sole layer has at least one arcuate shaped groove bending in the same lateral direction as the elongated through openings, and the at least one arcuate shaped groove is located on the inner instep side of the elongated through openings.

With the shoe sole according to the tenth aspect, it is possible to provide smooth deformation of the first sole layer starts in the width direction of the shoe sole.

In accordance with an eleventh aspect of the present disclosure, the shoe sole according to the seventh aspect or the eighth aspect is configured so that the third elongated through opening is shorter than the second elongated through opening.

With the shoe sole according to the eleventh aspect, the operability of the outer instep side of the first sole layer can be easily regulated based on the length of the third elongated through opening.

In accordance with a twelfth aspect of the present disclosure, the shoe sole according to the eleventh aspect is configured so that the plurality of the elongated through openings includes a fourth elongated through opening located on an outer instep side of the third elongated through opening. The fourth elongated through opening is shorter than the third elongated through opening.

With the shoe sole according to the twelfth aspect, the operability of the outer instep side of the first sole layer can be easily regulated based on the length of the fourth elongated through opening.

In accordance with a thirteenth aspect of the present disclosure, the shoe sole according to any one of the sixth aspect to the ninth aspect is configured so that the plurality of the elongated through openings has a concavity towards an outer instep side.

With the shoe sole according to the thirteenth aspect, it is possible to provide smooth deformation of the first sole layer starts in the width direction of the shoe sole.

In accordance with a fourteenth aspect of the present disclosure, the shoe sole according to any one of the first aspect to the thirteenth aspect further comprises a second sole layer at least partly overlapping the first sole layer. The first sole layer has a first flexibility. The second sole layer has a second flexibility that is more flexible than the first flexibility.

With the shoe sole according to the fourteenth aspect, the second sole layer can overlap the bottom surface of the first sole layer to provide additional features without restricting the stiffness in the width direction of the shoe sole.

In accordance with a fifteenth aspect of the present disclosure, the shoe sole according to any one of the first aspect to the fourteenth aspect further comprises a second sole layer at least partly overlapping the first sole layer. The first sole layer includes a first material. The second sole layer includes a second material different from the first material.

With the shoe sole according to the fifteenth aspect, the second sole layer can overlap the bottom surface of the first sole layer to provide additional features without restricting the stiffness in the width direction of the shoe sole.

In accordance with a sixteenth aspect of the present disclosure, the shoe sole according to the fifteenth aspect is configured so that the first material includes a plastic material.

With the shoe sole according to the sixteenth aspect, it is possible to easily regulate the rigidity of the first sole layer by using a plastic material.

In accordance with a seventeenth aspect of the present disclosure, the shoe sole according to the fifteenth aspect or the sixteenth aspect is configured so that the second material includes an elastic material.

With the shoe sole according to the seventeenth aspect, an amount of downward deformation of the shoe sole can be easily regulated based on the hardness of the elastic material that is used.

In accordance with an eighteenth aspect of the present disclosure, the shoe sole according to any one of the fourth aspect and the fourteenth aspect to the seventeenth aspect further comprises a third sole layer disposed on an opposite side of the second sole layer with respect to the first sole layer.

With the shoe sole according to the eighteenth aspect, the third sole layer can protect the second sole layer.

In accordance with a nineteenth aspect of the present disclosure, a shoe comprises the shoe sole according to any one of the first aspect to the eighteenth aspect, and further comprises an upper attached to the shoe sole.

With the shoe sole according to the nineteenth aspect, it is possible to provide a shoe that is that can appropriately deform in a width direction of the shoe sole while maintaining rigidity in a longitudinal direction of the shoe sole.

Also, other objects, features, aspects and advantages of the disclosed shoe sole will become apparent to those skilled in the shoe field from the following detailed description, which taken in conjunction with the annexed drawings, discloses preferred embodiments of the shoe sole.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the shoe field from this disclosure that the following descriptions of the embodiments are provided for illustration only and not for the purpose of limiting the invention as defined by the appended claims and their equivalents.

Figure 1:
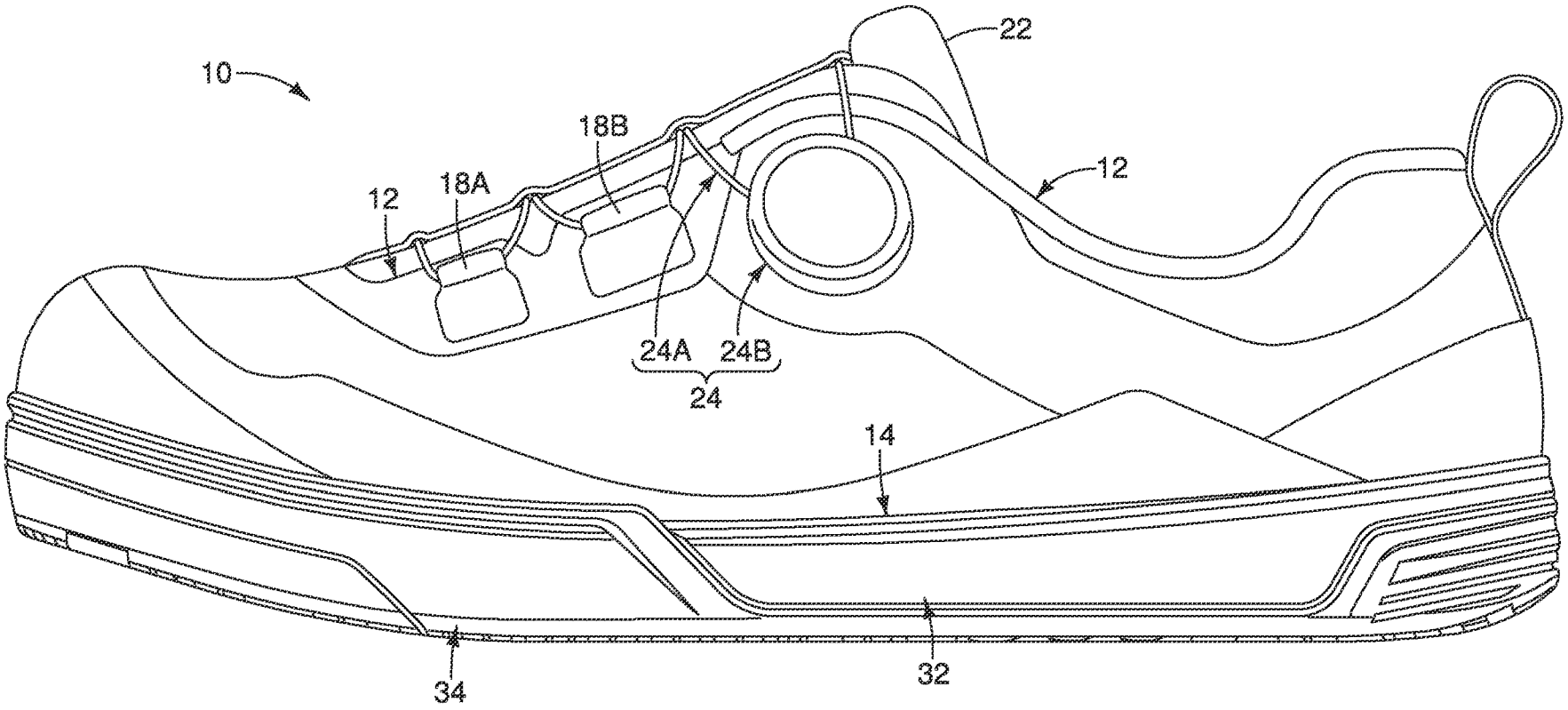
FIG. 1 is an outer side elevational view of a shoe having a shoe sole in accordance with a first embodiment.
Figure 2:
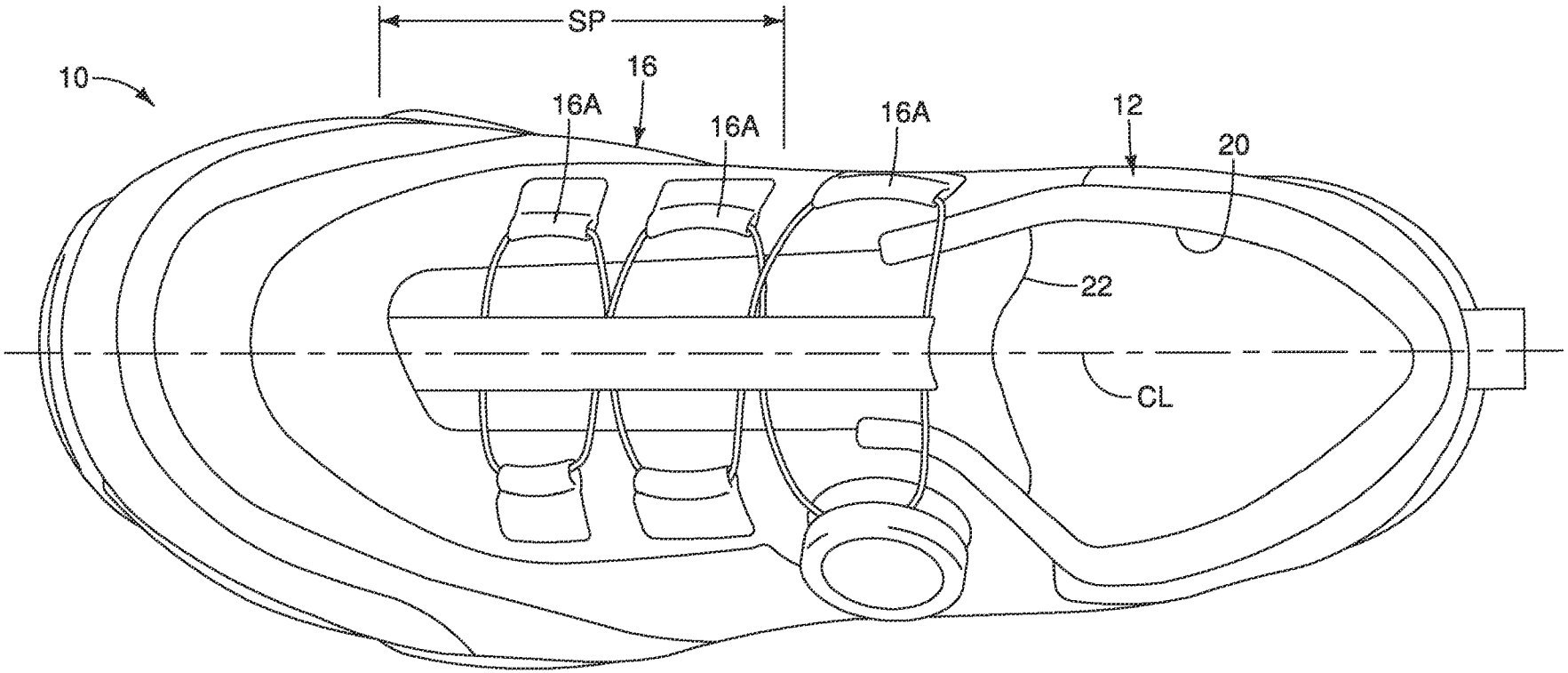
FIG. 2 is a top plan view of the shoe illustrated in FIG. 1.
Figure 3:
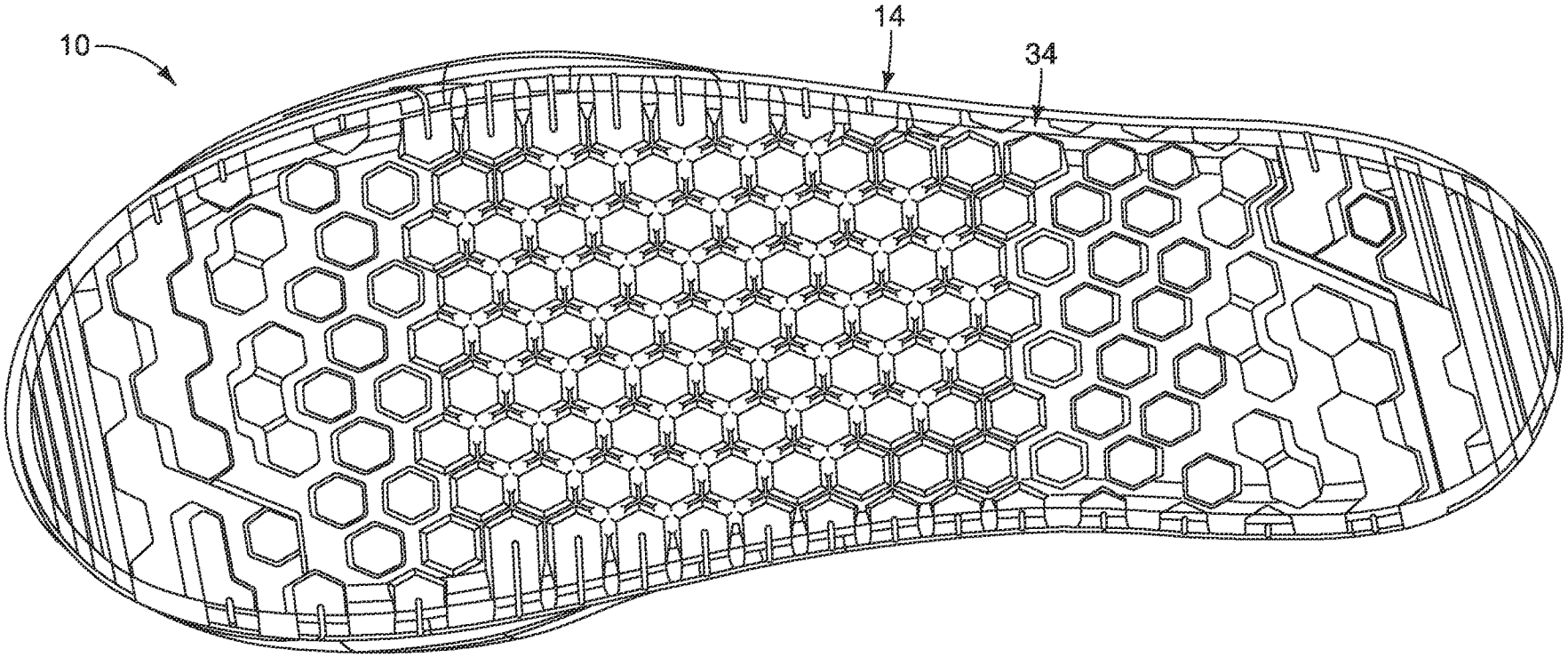
FIG. 3 is a bottom plan view of the shoe illustrated in FIG. 1.

Referring initially to FIGS. 1 to 3, a shoe 10 is illustrated in accordance with a first embodiment of the present disclosure. The shoe 10 is a left shoe of a pair of left-right symmetric ones, in which the right shoe is omitted. The right shoe is identical to the shoe 10 (the left shoe), except that the right shoe is a mirror image of the shoe 10 (the left shoe). Accordingly, description of the shoe 10 applies equally to the right shoe. Therefore, a description will be provided for only one of the shoes (the left shoe 10). The shoe 10 is especially suitable for cycling. However, the shoe 10 can be used for other actives other than cycling.

It should be understood from the drawings and the description herein that the terms "inner side" and "inboard side" refer to the right side of a shoe for the left foot, and the left side of a shoe for the right foot. In other words, the inner side or the inboard side is the side of the shoe facing the shoe on the other foot of the wearer. Similarly, the terms "outer side" and "outboard side" refer to the left side of the shoe for the left foot and the right side of the shoe for the right foot. The outer side or the outboard side is the side of the shoe facing away from the shoe on the other foot. As well, the terms "inner side" and "inboard side" are used interchangeably with respect to the present disclosure. Similarly, the terms "outer side" and "outboard side" are also used interchangeably with respect to the description of the present disclosure. Also, the term "outer instep side" refer to the left side of the shoe in the instep area for the left foot and the right side of the shoe in the instep area for the right foot. Similarly, the term "inner instep side" refer to the right side of the shoe in the instep area for the left foot and the left side of the shoe in the instep area for the right foot.

Figure 5:
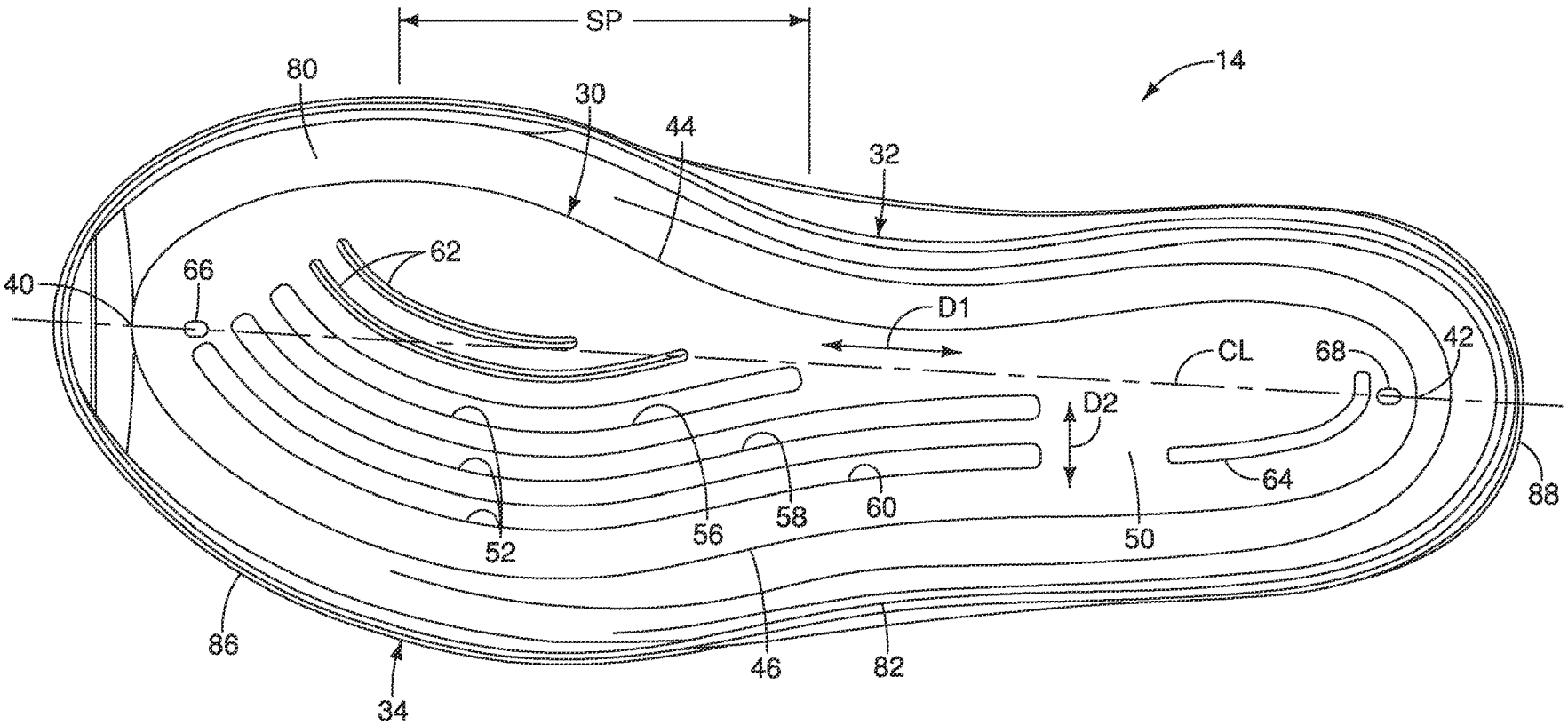
FIG. 5 is a top plan view of the shoe sole illustrated in FIG. 4.

Basically, the shoe 10 comprises an upper 12 and a shoe sole 14. In other words, the shoe 10 comprises the shoe sole 14 and further comprises the upper 12 which is attached to the shoe sole 14. As shown in FIGS. 2, 3 and 5, the shoe sole 14 includes a stepping part SP. The stepping part SP corresponds to the portion of the shoe 10 where a ball of a wearer's foot contacts the shoe sole 14. The stepping part SP is rearward of where wearer's toes contact the shoe sole 14 and forward of the arch of the wearer's foot in the shoe 10. The shoe 10 has a longitudinal centerline CL that extends between a front end of the shoe 10 and a rear end of the shoe 10.

Here, the upper 12 is a low-cut style of upper. However, the upper 12 is not limited to the low-cut style, but may be of any style. The upper 12 is made of any suitable natural or polymetric materials. The upper 12 can be formed of an expandable material or a non-expandable material. For example, the upper 12 can be made of a leather material, a nylon mesh and/or any other material that is utilized for conventional uppers.

As seen in FIG. 2, the upper 12 includes a first lateral side 16, a second lateral side 18 and an opening 20 between the first lateral side 16 and the second lateral side 18. The upper 12 further includes a tongue 22 between the first lateral side 16 and the second lateral side 18. The upper 12 further includes a closure 24 as a fastening structure for securing the shoe 10 to wearer's foot. The closure 24 includes at least one strap tightener 24A and at least one shoe strap 24B extending between the first lateral side 16 and the second lateral side 18. Here, the shoe strap 24B is a lace that is looped in eyelets 16A of the first lateral side 16 and that is looped in eyelets 18A of the second lateral side 18.

Alternatively, the upper 12 can include one or more fixing straps having a hook and loop fastener attachment with fabric hook and loop fastening materials. These fastening structures for securing shoes to wearer's feet are conventionally well-known structures. Thus, detail description of the fastening structures are omitted for the sake of brevity. The various portions of the upper 12 are stitched or otherwise fixed to one another. Since the present disclosure is applicable to a variety of differing shoe styles, designs and configuration, the depicted embodiment shows a basic shoe design that is made of several textile based materials that are sewn or stitched together to form the depicted shape. However, the present disclosure is not limited to the depicted shape, as will be understood from the description of the present disclosure below.

The shoe sole 14 supports the upper 12. Specifically, the shoe sole 14 is attached to the upper 12. The shoe sole 14 can be fixedly attached to the upper 12 in a conventional manner, such as with stitching, adhesives, and/or embedding portions of the upper 12 within the shoe sole 14. Thus, the upper 12 and the shoe sole 14 are integrated together.

Figure 4:
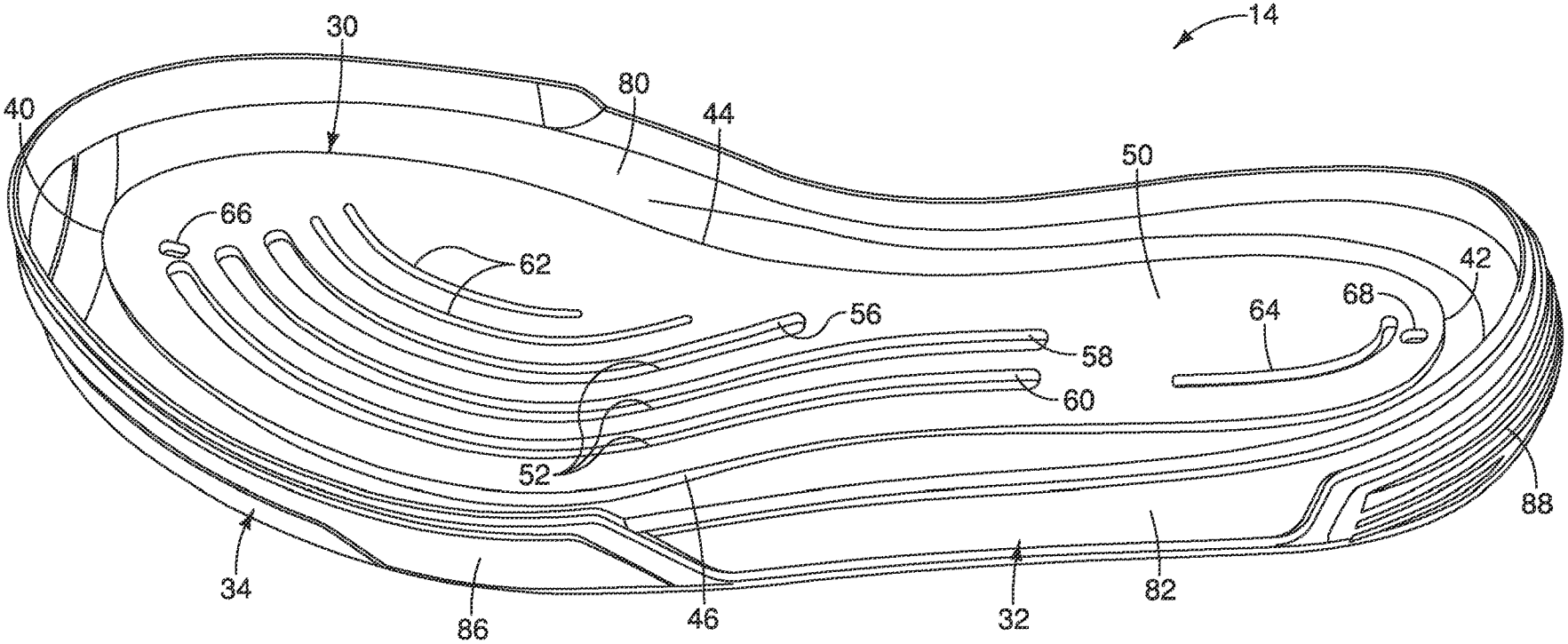
FIG. 4 is a top perspective view of the shoe sole of the shoe illustrated in FIGS. 1 to 3 as viewed from an outer side of the shoe sole.
Figure 6:
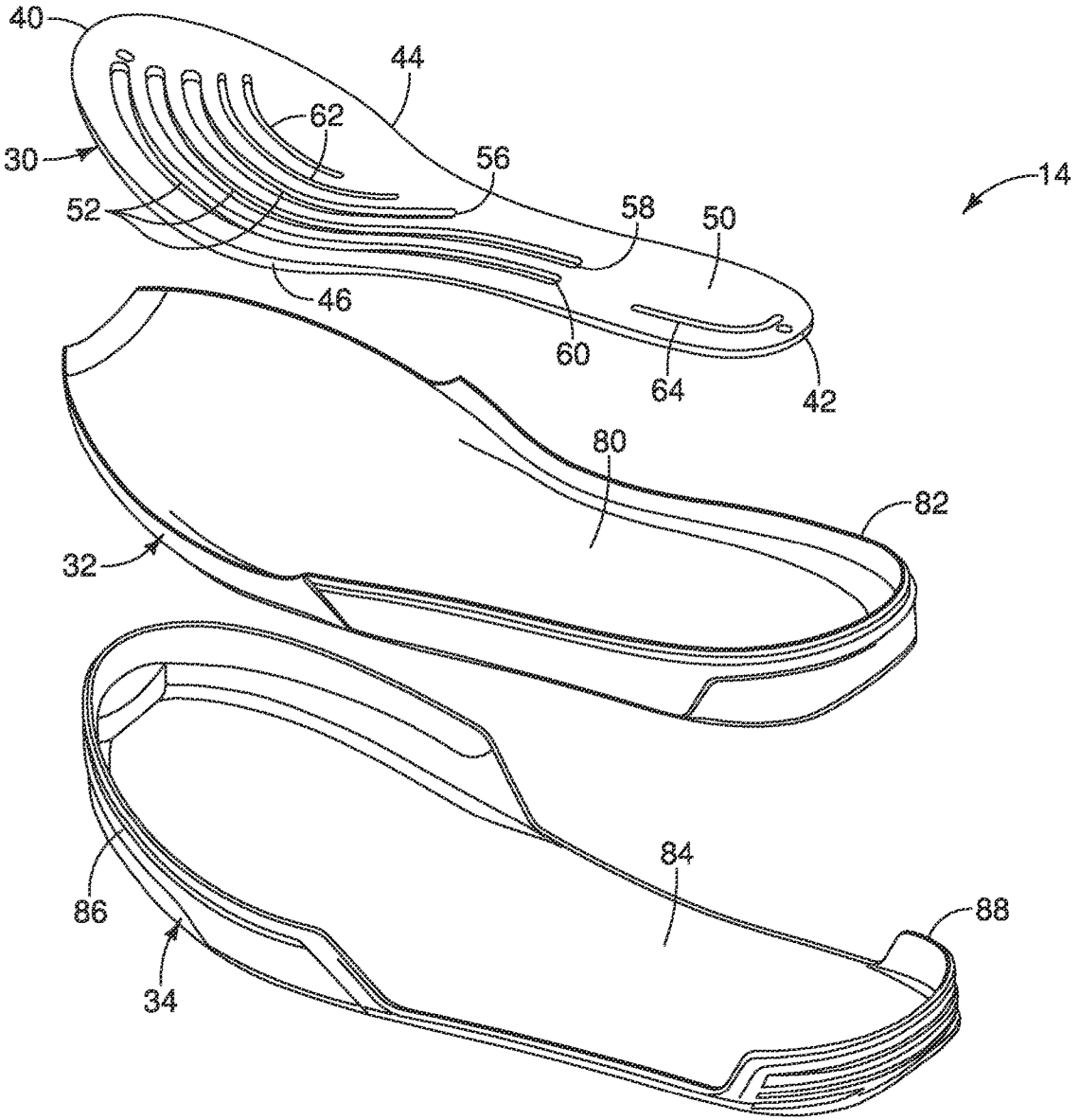
FIG. 6 is an exploded top perspective view of the shoe sole illustrated in FIGS. 4 and 5 as viewed from an outer side of the shoe sole.
Figure 7:
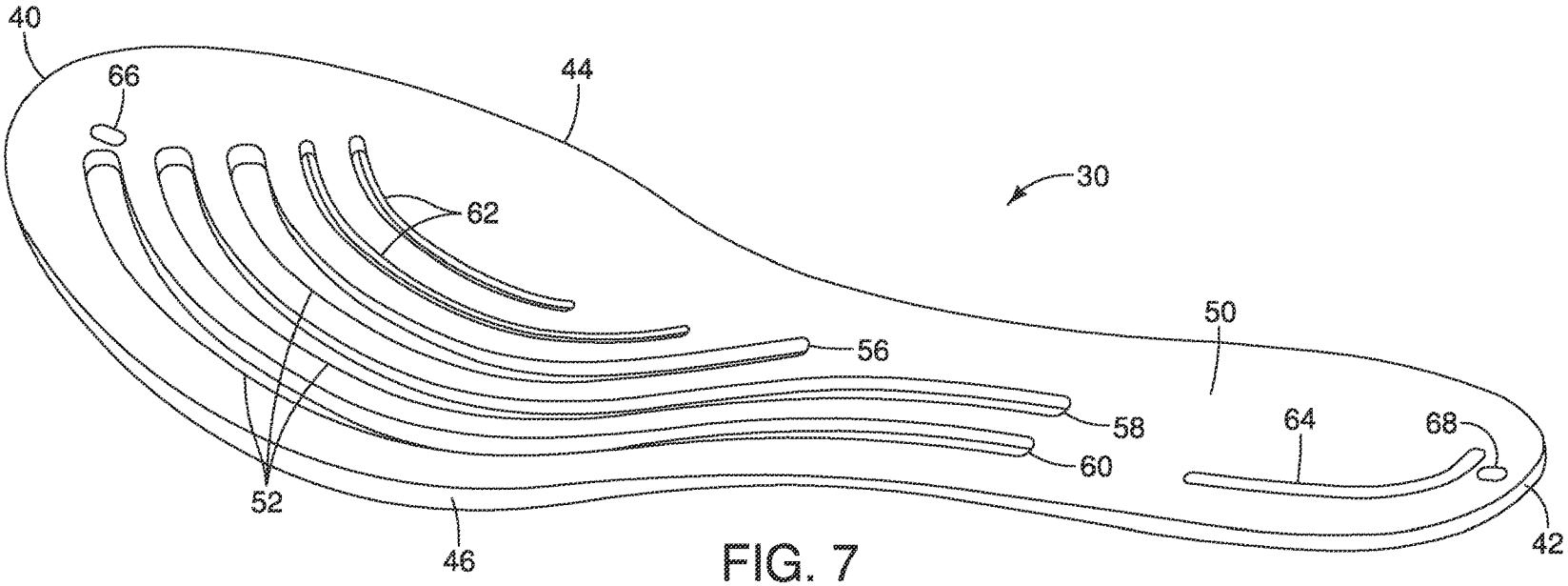
FIG. 7 is a top perspective view of a first layer of the shoe sole illustrated in FIGS. 4 to 6.
Figure 8:
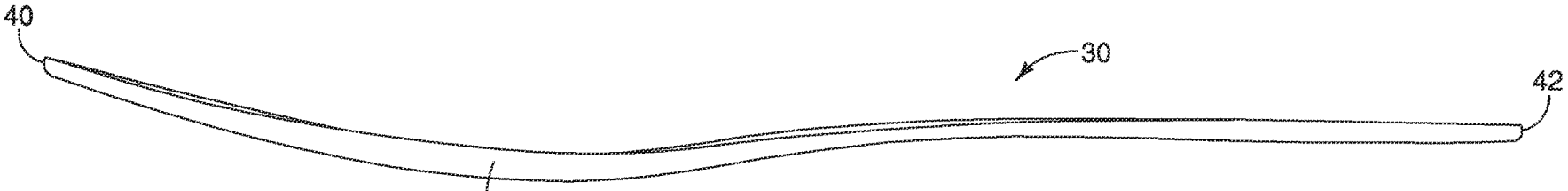
FIG. 8 is an outer side elevational view of the first layer illustrated in FIG. 7.

As seen in FIGS. 4 to 6, the shoe sole 14 comprises a first sole layer 30. The first sole layer 30 constitutes a first midsole layer. An insole can be inserted into the shoe to for overlying an upper surface of the first sole layer 30. Preferably, the shoe sole 14 further comprises a second sole layer 32 at least partly overlapping the first sole layer 30. The second sole layer 32 constitutes a second midsole layer. Thus, the first sole layer 30 and the second sole layer 32 constitute a midsole of the shoe 10. In the first embodiment, the first sole layer 30 is disposed adjacent to an upper 12 of the shoe 10 in a state where the shoe sole 14 is coupled to the upper 12. Also, preferably, in the first embodiment, the shoe sole 14 further comprises a third sole layer 34 that is disposed on an opposite side of the second sole layer 32 with respect to the first sole layer 30. In other words, the second sole layer 32 is disposed between the first sole layer 30 and the third sole layer 34. In particular, the second sole layer 32 overlies the third sole layer 34, and the first sole layer 30 overlies the second sole layer 32. Thus, the first sole layer 30 is disposed closer to a top of the shoe sole 14 than the second sole layer 32 in a state where the shoe sole 14 is assembled. Here, the third sole layer 34 is an outsole that is configured to contact the ground when walking. While the shoe sole 14 of the first embodiment has three layers, it will be apparent from this disclosure that the shoe sole 14 can have fewer than three layers or more than three layers. For example, the shoe sole 14 can have only the first sole layer 30 if needed and/or desired.

The first sole layer 30 includes a first material. The second sole layer 32 includes a second material. The second material is different from the first material. In the first embodiment, the first material includes a plastic material. For example, the first material of the first sole layer 30 includes a fiber (e.g., carbon fibers, glass fibers, etc.) reinforced plastic (FRP). The first sole layer 30 has a first flexibility. In the first embodiment, the second material includes an elastic material. For example, the second material of the second sole layer 32 includes an ethylene-vinyl acetate (EVA) copolymer, or a urethane. The second sole layer 32 can be formed by molding. The second sole layer 32 has a second flexibility that is more flexible than the first flexibility. The third sole layer 34 includes an elastic polymer material such as synthetic rubber or polyurethane (e.g., a thermoplastic polyurethane). The third sole layer 34 can be formed by injection molding.

Here, each of the first sole layer 30, the second sole layer 32, and the third sole layer 34 is a one-piece member is a one-piece member. The first sole layer 30, the second sole layer 32 and the third sole layer 34 are integrated together as a unit. The first sole layer 30 can be partly or fully embedded in the second sole layer 32, or can be adhesively attached to the second sole layer 32. The third sole layer 34 can molded to the second sole layer 32, or can be adhesively attached to the second sole layer 32. Alternatively, second sole layer 32 can molded to the third sole layer 34.

As seen in FIG. 5, the first sole layer 30 has an outer shape formed in a foot shape. The outer shape of the first sole layer 30 is slightly smaller than the outer shapes of the second sole layer 32 and the third sole layer 34. However, the first sole layer 30 does not need to be foot shaped and/or cover most of the second sole layer 32. The first sole layer 30 has a toe edge 40 and a heel edge 42. The longitudinal centerline CL extends between the toe edge 40 and the heel edge 42. The first sole layer 30 has an inner side edge 44 and an outer side edge 46. The inner side edge 44 and the outer side edge 46 extend between the toe edge 40 and the heel edge 42 to define a periphery of the first sole layer 30.

As seen in FIGS. 7 to 10, the first sole layer 30 includes a first region 50 having a first rigidity, and a plurality of second regions 52 having a second rigidity that is more flexible than the first rigidity. The first region 50 corresponds to those portions of the first sole layer 30 that is free of a through opening, a groove, or a reduced thickness. The second regions 52 correspond to those portions of the first sole layer 30 that include at least one of a through opening, a groove, a reduced thickness, or a material of reduced rigidity as compared to the rigidity of the material of the first region 50. The second sole layer 32 has a third rigidity that is more flexible than the first rigidity.

Preferably, the plurality of the second regions 52 extends in a longitudinal direction D1 of the shoe sole 14. The plurality of the second regions 52 is spaced from the toe edge 40 of the first sole layer 30. Also, the plurality of the second regions 52 is spaced from the heel edge 42 of the first sole layer 30. In other words, a portion of the first region 50 having the first rigidity is disposed between the toe edge 40 and the second region 52. Also, a portion of the first region 50 having the first rigidity is disposed between the heel edge 42 and the second region 52. In the first embodiment, the plurality of the second regions 52 has arcuate shapes bending in a same lateral direction D2. Here, the plurality of the second regions 52 extends to the stepping part SP of the shoe sole 14 in the longitudinal direction D1. The first region 50 also extends in the longitudinal direction D1 of the shoe sole 14 to maintain longitudinal rigidity.

In the first embodiment, the plurality of the second regions 52 includes a plurality of elongated through openings. Alternatively, one or more of the elongated through openings can be an elongated area of reduced rigidity such as a groove or a material of reduced rigidity as compared to the first region 50. Here, the plurality of the elongated through openings includes a first elongated through opening 56 and a second elongated through opening 58. The first elongated through opening 56 is located on an inner instep side of the second elongated through opening 58. The second elongated through opening 58 is longer than the first elongated through opening 56.

Also, here, the plurality of the elongated through openings further includes a third elongated through opening 60 located on an outer instep side of the second elongated through opening 58. The third elongated through opening 60 is longer than the first elongated through opening 56. Also, the third elongated through opening 60 is equal to or longer than the second elongated through opening 58. In the first embodiment, the plurality of the elongated through openings 56, 58 and 60 has a concavity towards the inner instep side. Here, the elongated through openings 56, 58 and 60 are parallel arcs.

Figure 9:
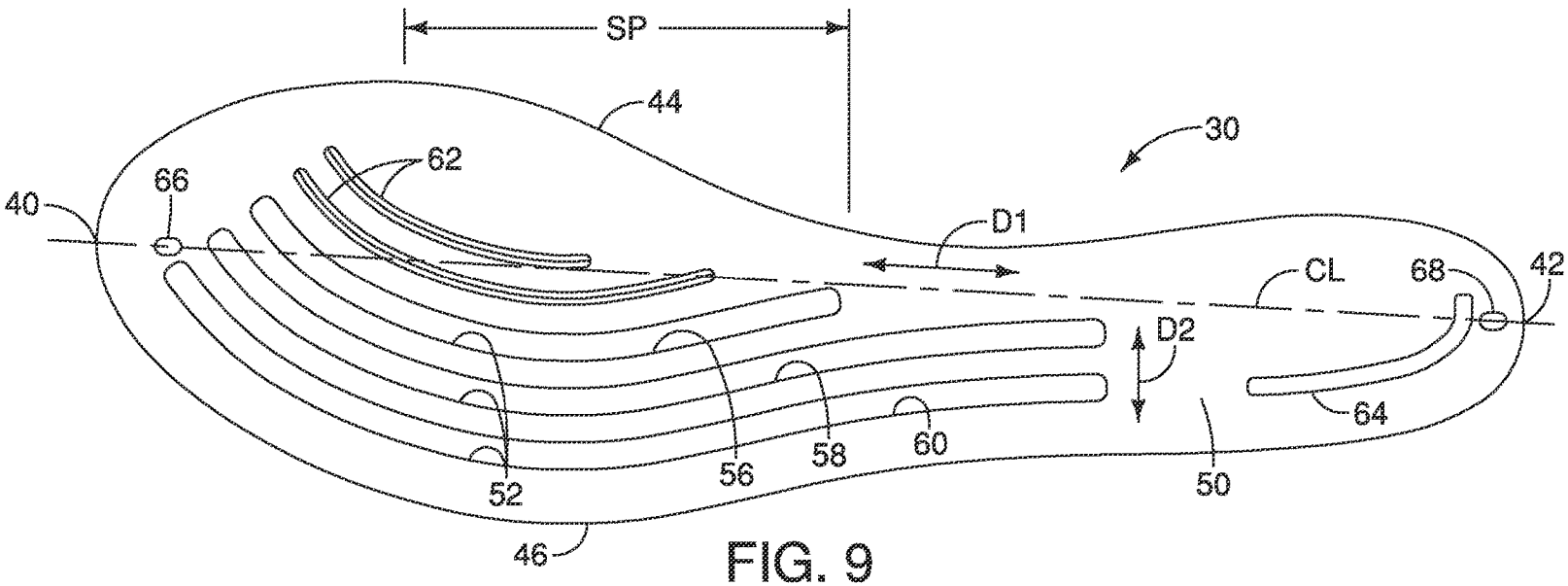
FIG. 9 is a top plan view of the first layer illustrated in FIGS. 7 and 8.

Preferably, the first sole layer 30 has at least one arcuate shaped groove 62 bending in the same lateral direction D2 as the elongated through openings 52. The at least one arcuate shaped groove 62 is located on the inner instep side of the elongated through openings 52. Here, the first sole layer 30 has two of the arcuate shaped grooves 62. The arcuate shaped grooves 62 are not through openings, thus do not extend completely through the first sole layer 30 in a thickness direction of the first sole layer 30. Preferably, the arcuate shaped grooves 62 are formed in the top surface of the first sole layer 30 as seen in FIG. 9. Each of the arcuate shaped groove s62 has a concavity towards the inner instep side. The arcuate shaped grooves 62 can be the same length or different lengths. Here, the arcuate shaped groove 62 located closer to the inner instep side is smaller in length than the length of the arcuate shaped groove 62 located closer to the outer instep side.

Figure 10:
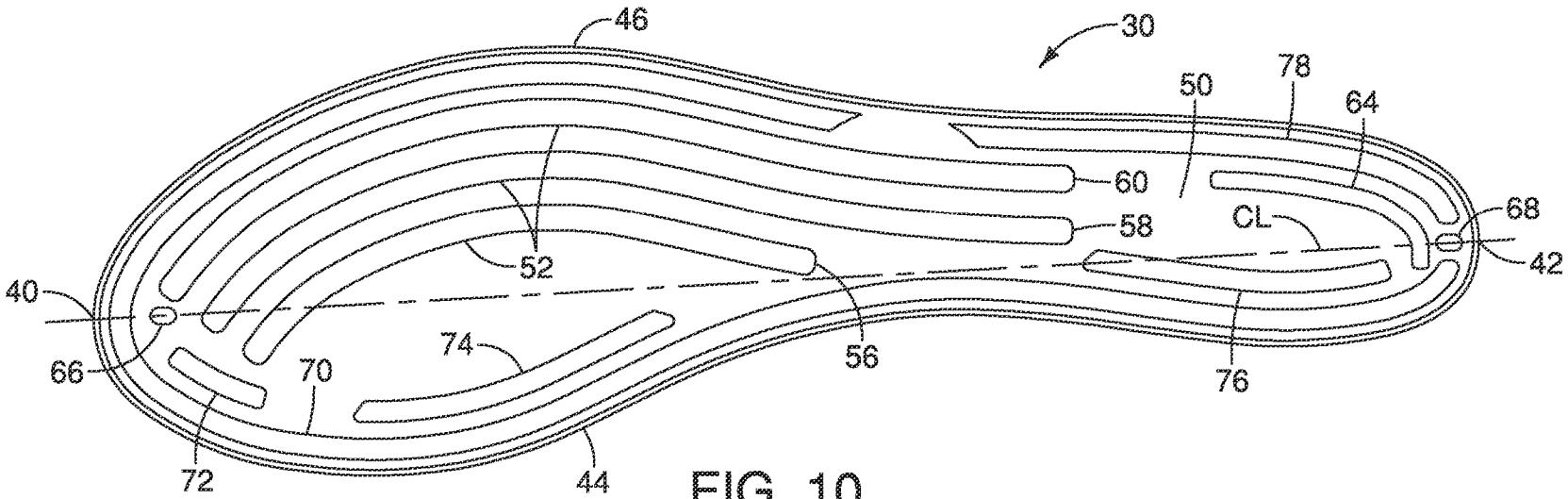
FIG. 10 is a bottom plan view of the first layer illustrated in FIGS. 7 to 9.
Figure 11:
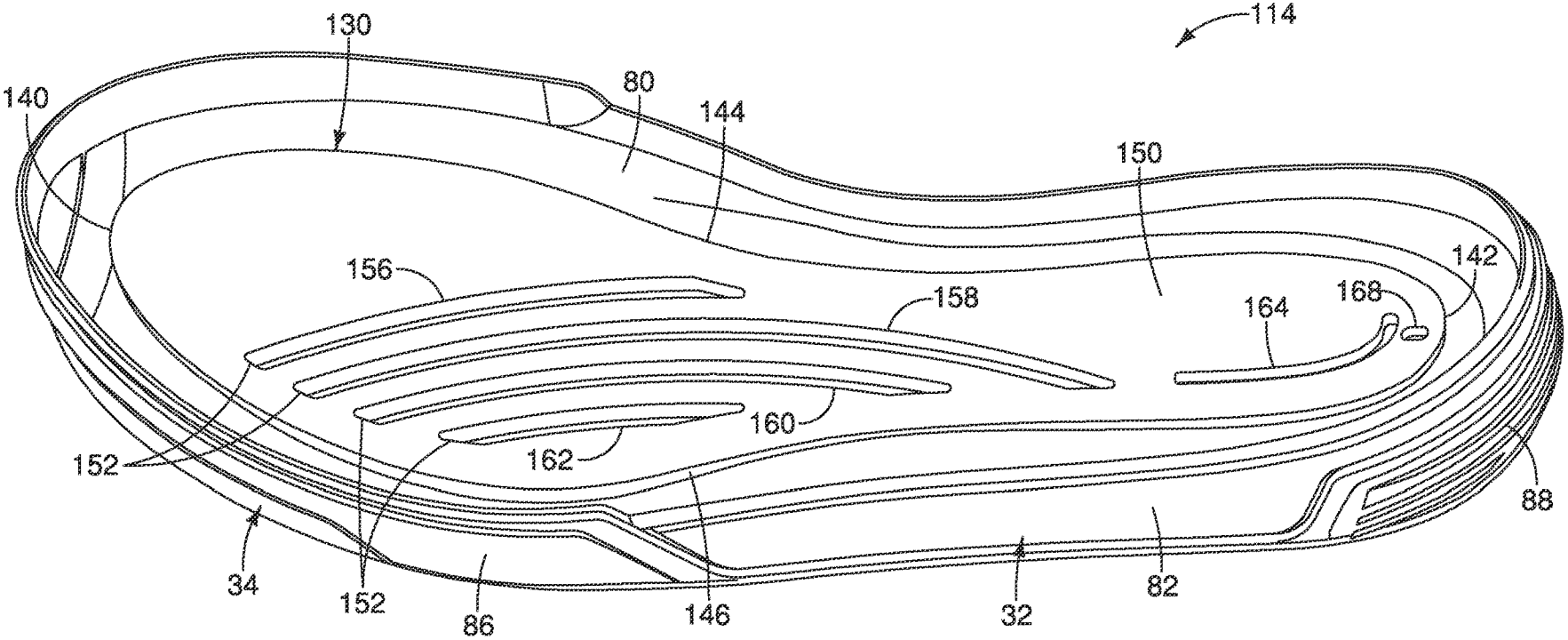
FIG. 11 is a top perspective view of a shoe sole in accordance with a second embodiment.
Figure 12:
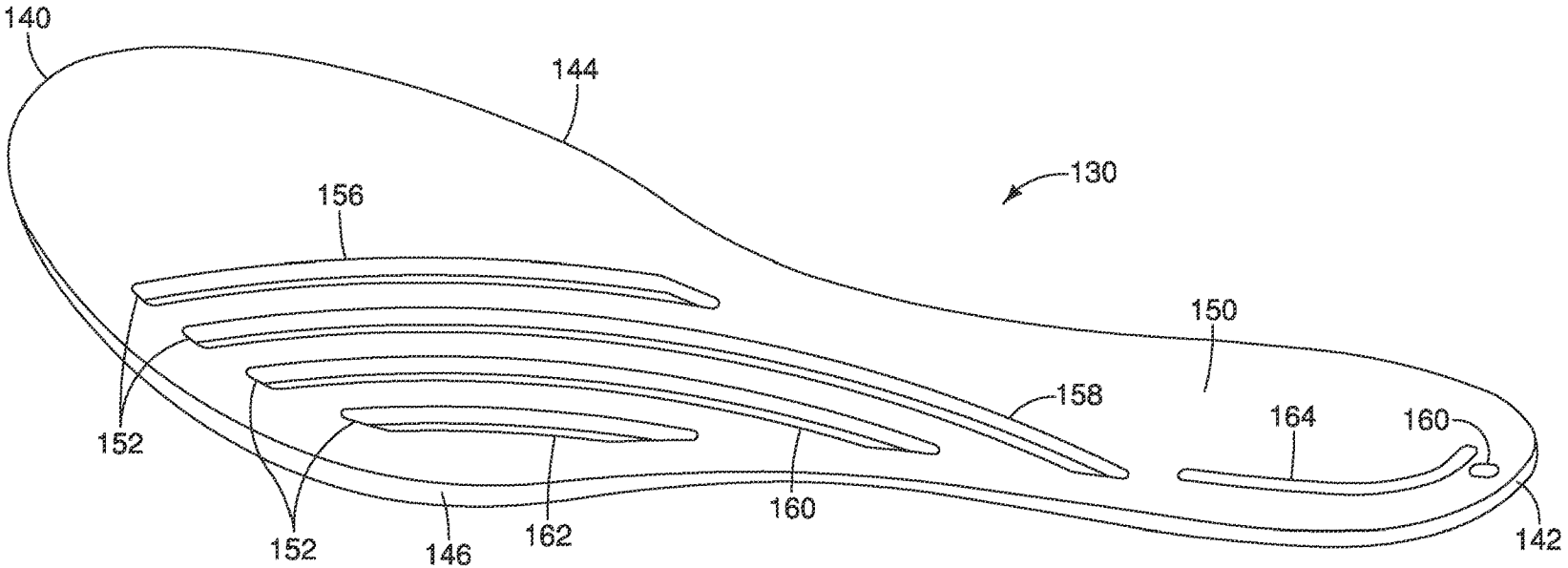
FIG. 12 is a top perspective view of a first layer of the shoe sole illustrated in FIG. 11.
Figure 13:
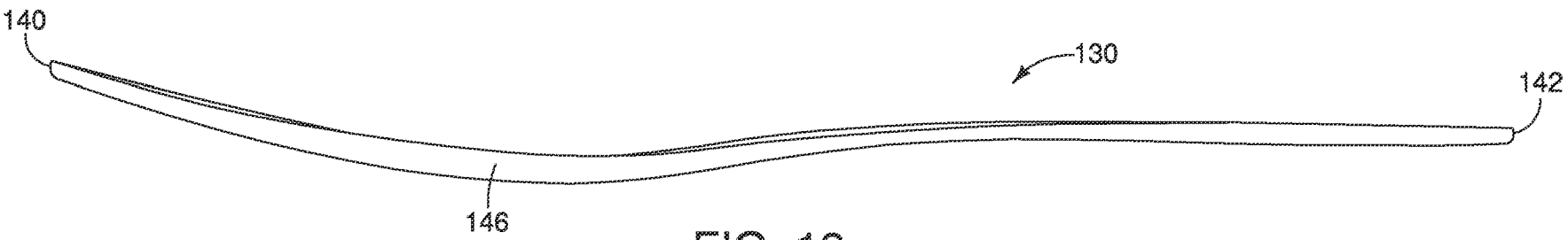
FIG. 13 is an outer side elevational view of the first layer illustrated in FIG. 12.

Preferably, as seen in FIGS. 9 and 10, optionally, the first sole layer 30 has an elongated through openings 64 located in a heel part of the first sole layer 30. Also, optionally, the first sole layer 30 has a first through opening 66 located in the toe area of the first sole layer 30, and a second through opening 68 located in the heel area of the first sole layer 30. As seen in FIG. 10, optionally, the bottom surface of the first sole layer 30 can be provided with a plurality of grooves 70, 72, 76 and 78. In this way, the first sole layer 30 has desired rigidity.

Referring to FIG. 6, the second sole layer 32 includes a base portion 80 that is foot-shaped. The base portion 80 is larger than the first sole layer 30. Thus, the base portion 80 supports the first sole layer 30. The second sole layer 32 further includes a side portion 82 that partially overlies the upper 12 (see FIG. 1). Preferably, the upper 12 is attached to the side portion 82 by stitching, adhesives, and/or embedding portions of the upper 12 within the side portion 82.

Still referring to FIG. 6, the third sole layer 34 includes a base portion 84 that is foot-shaped. The base portion 84 is larger than the base portion 80 of the second sole layer 32. Thus, the base portion 84 of the third sole layer 34 supports the base portion 80 of the second sole layer 32. The third sole layer 34 further includes a first side portion 86 and a second side portion 88. The first side portion 86 and the second side portion 88 partially overlie the upper 12 (see FIG. 1). Preferably, the upper 12 is attached to the first side portion 86 and the second side portion 88 by stitching, adhesives, and/or embedding portions of the upper 12 within first side portion 86 and the second side portion 88.

Referring now to FIGS. 11 to 15, a shoe sole 114 is illustrated in accordance with a second embodiment. The shoe sole 114 can be used with the upper 12 to form a shoe similar to the first embodiment. Here, the shoe sole 114 comprises a first sole layer 130 and further comprises the second sole layer 32 and the third sole layer 34 of the first embodiment. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. Thus, the following description will focus on the first sole layer 130.

Here, the first sole layer 130 overlies the second sole layer 32, which overlies the third sole layer 34 in the same manner as the first embodiment. Preferably, the first sole layer 130 is made of a plastic material having a first flexibility. Thus, the second flexibility of the second sole layer 32 is more flexible than the first flexibility of the first sole layer 130. The first sole layer 130 has an inner side edge 144 and an outer side edge 146. The inner side edge 144 and the outer side edge 146 extend between the toe edge 140 and the heel edge 142 to define a periphery of the first sole layer 130.

The first sole layer 130 includes a first region 150 having a first rigidity, and a plurality of second regions 152 having a second rigidity that is more flexible than the first rigidity. The first region 150 corresponds to those portions of the first sole layer 130 that is free of a through opening, a groove, or a reduced thickness. The second regions 152 correspond to those portions of the first sole layer 130 that include at least one of a through opening, a groove, or a reduced thickness. The second sole layer 132 has a third rigidity that is more flexible than the first rigidity.

Preferably, the plurality of the second regions 152 extends in a longitudinal direction D1 of the shoe sole 114. The plurality of the second regions 152 is spaced from the toe edge 140 of the first sole layer 130. Also, the plurality of the second regions 152 is spaced from the heel edge 142 of the first sole layer 130. Here, the plurality of the second regions 152 extends to the stepping part SP of the shoe sole 114 in the longitudinal direction D1. In the second embodiment, the plurality of the second regions 152 has arcuate shapes bending in a same lateral direction D2.

In the second embodiment, the plurality of the second regions 152 includes a plurality of elongated through openings. In particular, here, the plurality of the elongated through openings includes a first elongated through opening 156 and a second elongated through opening 158. The first elongated through opening 156 is located on an inner instep side of the second elongated through opening 158. The second elongated through opening 158 is longer than the first elongated through opening 156.

Also, here, the plurality of the elongated through openings further includes a third elongated through opening 160 located on an outer instep side of the second elongated through opening 158. In the second embodiment, the third elongated through opening 160 is shorter than the second elongated through opening 158. Also, here, the plurality of the elongated through openings 152 includes a fourth elongated through opening 162 located on an outer instep side of the third elongated through opening 160. The fourth elongated through opening 162 is shorter than the third elongated through opening 160. In the second embodiment, the plurality of the elongated through openings 156, 158, 160 and 162 has a concavity towards an outer instep side.

Figure 14:
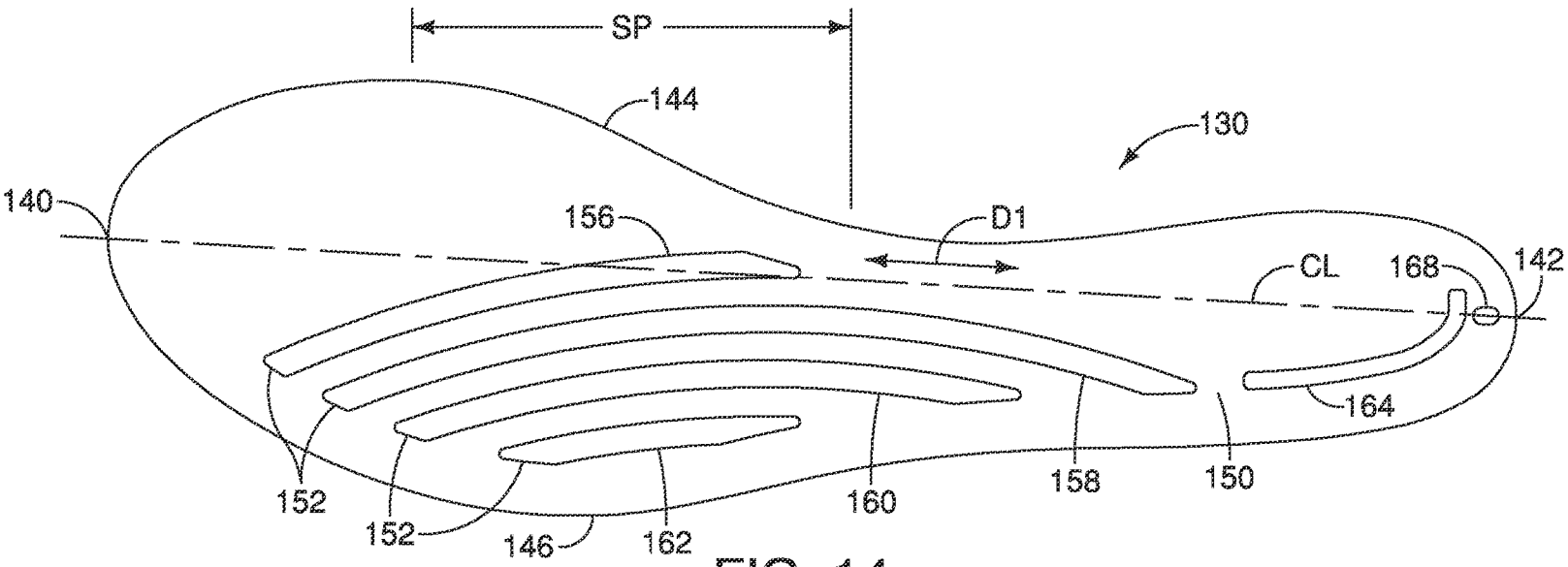
FIG. 14 is a top plan view of the first layer illustrated in FIGS. 12 and 13.
Figure 15:
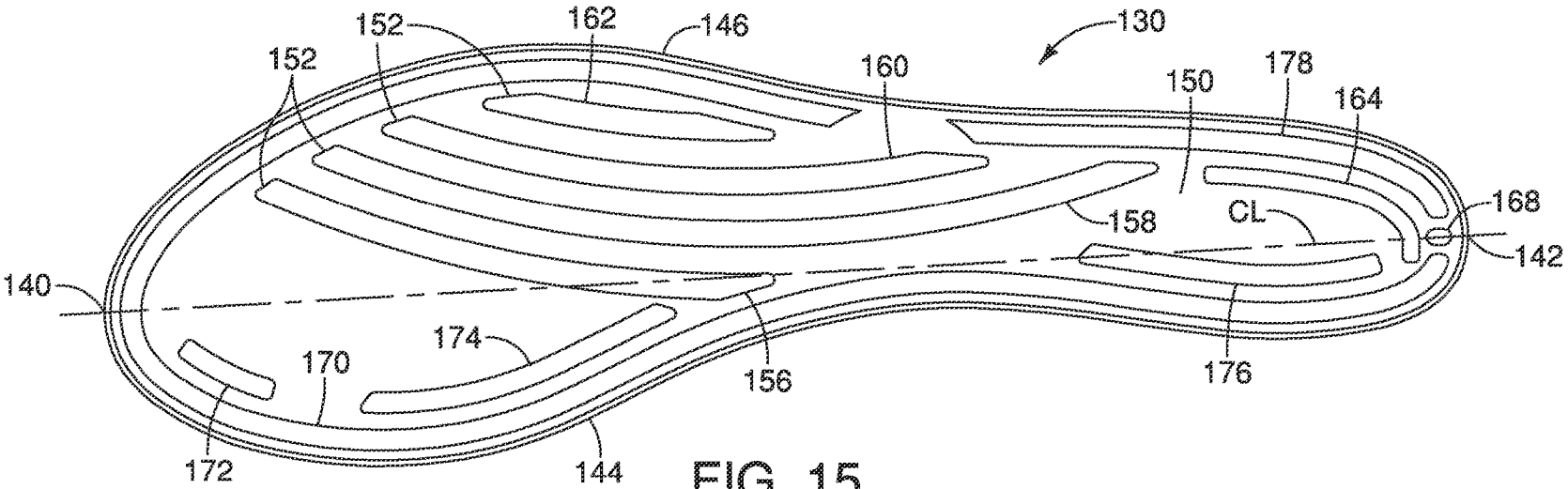
FIG. 15 is a bottom plan view of the first layer illustrated in FIGS. 12 to 14.

Preferably, as seen in FIGS. 14 and 15, the first sole layer 130 has an elongated through openings 164 located in a heel part of the first sole layer 130. Also, optionally, the first sole layer 30 has a first through opening 166 located in the toe area of the first sole layer 130, and a second through opening 168 located in the heel area of the first sole layer 130. As seen in FIG. 15, optionally, the bottom surface of the first sole layer 130 can be provided with a plurality of grooves 170, 172, 176 and 178. In this way, the first sole layer 130 has desired rigidity.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shoe sole comprising:

a first sole layer including a first region having a first rigidity, and a plurality of second regions having a second rigidity that is more flexible than the first rigidity, the first sole layer having an inner instep side and an outer instep side; wherein the plurality of the second regions extends in a longitudinal direction of the shoe sole, the plurality of the second regions is spaced from a toe edge of the first sole layer and is spaced from a heel edge of the first sole layer, and the plurality of the second regions has arcuate shapes bending in a same lateral direction, the plurality of the second regions includes a plurality of elongated through openings, each of the plurality of elongated through openings extending completely through the first sole layer from an upper surface to a lower surface thereof, and the first sole layer has at least one arcuate shaped groove bending in the same lateral direction as the elongated through openings, and each of the at least one arcuate shaped grooves being located nearer the inner instep side than any one of the elongated through openings.

2. The shoe sole according to claim 1, wherein the plurality of the second regions extends to a stepping part of the shoe sole in the longitudinal direction.

3. The shoe sole according to claim 1, further comprising a second sole layer at least partly overlapping the first sole layer, the second sole layer having a third rigidity that is more flexible than the first rigidity, wherein the first sole layer is disposed closer to a top of the shoe sole than the second sole layer in a state where the shoe sole is assembled.

4. The shoe sole according to claim 3, further comprising a third sole layer disposed on an opposite side of the second sole layer with respect to the first sole layer.

5. The shoe sole according to claim 1, wherein the first sole layer is disposed adjacent to an upper of a shoe in a state where the shoe sole is coupled to the upper.

6. The shoe sole according to claim 1, wherein the plurality of the elongated through openings includes a first elongated through opening and a second elongated through opening, the first elongated through opening is located on an inner instep side of the second elongated through opening, the second elongated through opening is longer than the first elongated through opening.

7. The shoe sole according to claim 6, wherein the plurality of the elongated through openings further includes a third elongated through opening located on an outer instep side of the second elongated through opening, the third elongated through opening is longer than the first elongated through opening.

8. The shoe sole according to claim 7, wherein the third elongated through opening is equal to or longer than the second elongated through opening.

9. The shoe sole according to claim 7, wherein the third elongated through opening is shorter than the second elongated through opening.

10. The shoe sole according to claim 9, wherein the plurality of the elongated through openings includes a fourth elongated through opening located on an outer instep side of the third elongated through opening, the fourth elongated through opening is shorter than the third elongated through opening.

11. The shoe sole according to claim 6, wherein the plurality of the elongated through openings has a concavity towards the inner instep side.

12. The shoe sole according to claim 6, wherein the plurality of the elongated through openings has a concavity towards an outer instep side.

13. The shoe sole according to claim 1, further comprising a second sole layer at least partly overlapping the first sole layer, wherein the first sole layer has a first flexibility, and the second sole layer has a second flexibility that is more flexible than the first flexibility.

14. The shoe sole according to claim 1, further comprising a second sole layer at least partly overlapping the first sole layer, wherein the first sole layer includes a first material, and the second sole layer includes a second material different from the first material.

15. The shoe sole according to claim 14, wherein the first material includes a plastic material.

16. The shoe sole according to claim 14, wherein the second material includes an elastic material.

17. A shoe comprising the shoe sole according to claim 1, further comprising an upper attached to the shoe sole.

18. A shoe sole comprising:

a first sole layer including a first region having a first rigidity, and a plurality of second regions having a second rigidity that is more flexible than the first rigidity, the first sole layer having an inner instep side and an outer instep side; wherein the plurality of the second regions extends in a longitudinal direction of the shoe sole, the plurality of the second regions is spaced from a toe edge of the first sole layer and is spaced from a heel edge of the first sole layer, the plurality of the second regions having arcuate shapes bending in a same lateral direction having a concavity toward the inner instep side, each of the plurality of the second regions being spaced apart in the lateral direction along an entire length thereof, the first sole layer including a plurality of first grooves disposed on a foot facing surface of the first sole layer, each of the plurality of first grooves not extending entirely through the first sole layer and being spaced from the toe edge of the first sole layer, and the first sole layer including a second groove disposed on a non-foot facing surface of the first sole layer, the second groove not extending entirely through the first sole layer and being spaced from the toe edge of the first sole layer, the second groove having a concavity different from the concavity of each of the plurality of first grooves.

* * * * *